US005806706A

United States Patent [19]

Koskinen

[11] Patent Number: 5,806,706

[45] Date of Patent: Sep. 15, 1998

[54] CONTAINER MEANT FOR BULK GOODS

[75] Inventor: Erkki Koskinen, Pori, Finland

[73] Assignee: UPM-Kymmene Oy, Helsinki, Finland

[21] Appl. No.: 809,200

[22] PCT Filed: Jul. 5, 1996

[86] PCT No.: PCT/FI96/00397

§ 371 Date: Feb. 27, 1997

§ 102(e) Date: Feb. 27, 1997

[87] PCT Pub. No.: WO97/03002

PCT Pub. Date: Jan. 30, 1997

[30] Foreign Application Priority Data

Jul. 7, 1995 [FI] Finland ..... 953354

[51] Int. Cl.[6] ..... B65D 5/60

[52] U.S. Cl. ..... 220/408; 220/453; 229/14

[58] Field of Search ..... 220/652, 653, 220/408, 453; 229/14

[56] References Cited

U.S. PATENT DOCUMENTS

| | | | |
|---|---|---|---|
| 1,709,510 | 4/1929 | White | 229/14 |
| 2,563,508 | 8/1951 | Anschicks | 220/453 X |
| 3,082,900 | 3/1963 | Goodman | 220/408 X |
| 4,742,951 | 5/1988 | Kelly et al. | 220/408 X |
| 4,781,475 | 11/1988 | Lafleur | 383/119 |
| 4,901,885 | 2/1990 | Boots | 220/402 |
| 4,978,028 | 12/1990 | George et al. | 220/408 X |
| 5,091,231 | 2/1992 | Parkinson | 220/453 X |
| 5,544,472 | 8/1996 | Koskinen et al. | 53/449 |
| 5,579,950 | 12/1996 | Yamanaka | 220/453 X |

FOREIGN PATENT DOCUMENTS

| | | |
|---|---|---|
| 247696 | 12/1987 | European Pat. Off. . |
| 3766662 | 7/1990 | European Pat. Off. . |
| 171359 | 7/1988 | Norway . |
| 9317911 | 6/1993 | WIPO . |

*Primary Examiner*—Steven M. Pollard
*Attorney, Agent, or Firm*—Steinberg & Raskin, P.C.

[57] ABSTRACT

The invention concerns a container (100) which is made of a tubular material (111), which is meant for bulk goods, and which comprises at least an outer wall (112), a bottom portion (114) and possibly a top portion. In the interior of the container (100), a cylindrical reinforcement part (113) has been fitted, which has been fixed to the container (100) so that, at the same time, the cylindrical reinforcement part (113) forms at least a part of the bottom (114) of the container. The height (S) of the cylindrical reinforcement part (113) is by the lower portion (113*a*) of the cylindrical reinforcement part (113) higher than the filling height (H) of the container (100).

20 Claims, 3 Drawing Sheets

CONTAINER MEANT FOR BULK GOODS

FIELD OF THE INVENTION

The invention concerns a container which is made of a tubular material, which is meant for bulk goods, and which comprises at least an outer wall, a bottom portion and possibly a top portion.

BACKGROUND OF THE INVENTION

With respect to the prior art, reference is made to the publication EP 0,247,696, in which a container intended for bulk goods is described. The container comprises a tubular outer frame, which can be closed from both ends, and a tubular inner member. The circumferential measure of the tubular inner member is smaller than the circumferential measure of the outer frame of the container, and the difference between said circumferential measures is such that hollow spaces are formed in each corner of the tubular outer frame between the tubular outer frame and the tubular inner member. The tubular inner member is in contact with the tubular outer frame in at least four points placed circumferentially at a distance from one another. The tubular inner member has been fixed to the tubular outer frame from the contact points, and the height of the tubular inner member is 30% to 100% of the height of the tubular outer frame.

The above container in accordance with said EP Patent 0,247,696 is unfavorable in the sense that, when the container is filled with bulk goods, the lower portion of the container tends to expand, especially when the container is stacked. This phenomenon is highly intensive in particular when the container is made of a resilient material, such as a plastic film. This phenomenon results in inclined distortion of the filled package, which again deteriorates the stacking quality and handling quality of the packages. Even though, in principle, the package is not necessarily broken as a result of the expansion of the lower portion, there is a risk that, when such containers are loaded, adjacent containers may rub against each other and, thus, be even broken. Likewise, the use of such containers in modern automatic warehouses is impossible. If the top portion of the inner ring of such a prior-art container is not completely filled, i.e. the height of the inner ring is lower than the height of the outer ring, the result is that the top portion of the container can expand. Even though, in principle, expansion of the top portion of the container facilitates the stacking, the containers stacked one on top of the other, however, involve the risk that expansion of the top portion of the container results in a risk of falling over of the containers stacked one on top of the other.

OBJECTS AND SUMMARY OF THE INVENTION

The object of the present invention is to provide an improvement over the prior-art container constructions. It is a more specific object of the invention to provide a container in which the drawbacks present in the container in accordance with the EP Patent 0,247,696 have been eliminated.

It is a further object of the invention to provide a container construction by whose means transportation packages that have been manufactured by means of the methods in accordance with the Finnish Patents 90,331 and 91,954 can be given optimal handling and stacking properties.

The objectives of the invention are achieved by means of a container made of a tubular material, which container is characterized in that, in the interior of the container, a cylindrical reinforcement part has been fitted, which has been fixed to the container so that, at the same time, the cylindrical reinforcement part forms at least a part of the bottom of the container.

In a preferred embodiment of the invention, the cylindrical reinforcement part is, at the top end, higher than the filling height of the container, in which case the cylindrical reinforcement part is, at the same time, fitted to form at least a part of a possible top portion, if any, of the container.

The cylindrical reinforcement part has been fixed to the outer wall and to the bottom portion of the container. The fastening of the bottom portion can be favourably such that it just ensures that the cylindrical reinforcement part is positioned as a part of the bottom in the desired way.

According to the basic realization of the invention, the height of the cylindrical reinforcement part is always higher than the filling height of the container.

In practice, as a rule, it is advantageous to make cuts into the comers of the bottom portion and/or the top portion of the reinforcement part, in which case the space between the reinforcement part and the outer wall is filled and emptied readily. Owing to the cuts, sector-shaped portions are formed into the reinforcement part.

When the container in accordance with the invention is made of a resilient material, such as a plastic film, it is excellently suitable for use as an inner package, for example in unit-load sacks.

By means of a container in accordance with the invention, a number of significant advantages are obtained. The stacking and handling quality of the container in accordance with the invention is excellent, and in a container in accordance with the present invention the lower portion of the container cannot expand to a detrimental extent. In a container in accordance with the invention, detrimental expansion of the top portion of the container can be prevented in a similar way by making the top portion of the cylindrical reinforcement part sufficiently high, in which case, at the same time, the top portion of the reinforcement part forms at least a part of a possible top portion, if any, of the container. The container in accordance with the invention also permits the use of a thinner material in the reinforcement part, which provides obvious economies in the costs. In the container in accordance with the invention, it has been realized to provide a reinforcement at the location in the container to which the highest strain is applied. Further, by means of the invention, it is possible to manufacture a container of permanent shape in particular out of resilient materials, preferably polyolefin plastic. The container in accordance with the invention can also be filled with liquid, instead of bulk goods.

BRIEF DESCRIPTION OF THE DRAWINGS

The invention will be described in detail with reference to some preferred embodiments of the invention illustrated in the figures in the accompanying drawings, the invention being, yet, not supposed to be confined to said embodiments alone.

DETAILED DESCRIPTION OF THE INVENTION

Figure 1:
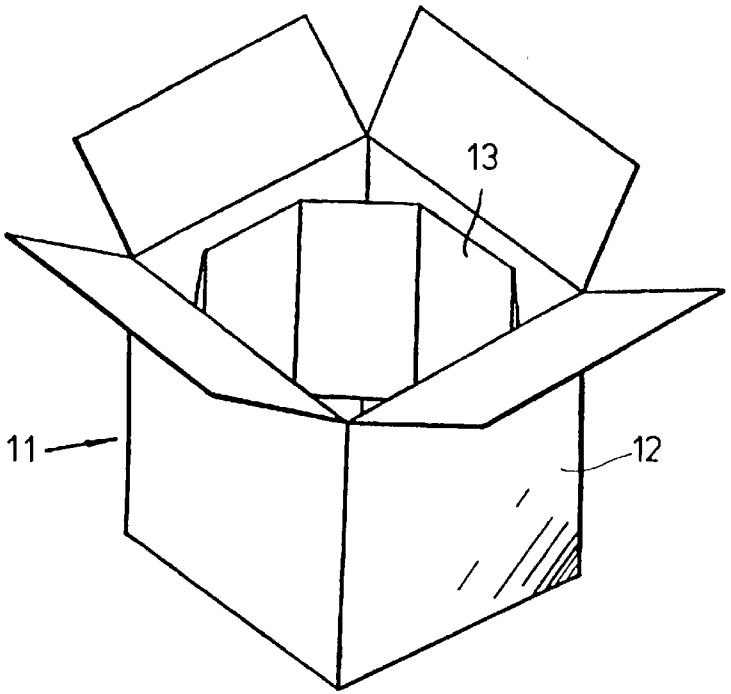
FIG. 1 PRIOR ART
FIG. 1 is an axonometric view of a prior-art container.

The prior-art container shown in FIGS. 1 and 2 is a box 11, which is made, for example, of paperboard, corrugated board, or equivalent. The box 11 comprises an outer frame 12 and an inner member 13.

Figure 2A:
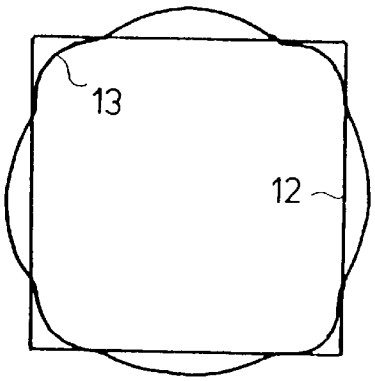
FIG. 2a PRIOR ART
FIG. 2*a* is a sectional view of a prior-art container as shown in FIG. 1 taken from a level of about 100 mm from the bottom of the container.
Figure 2B:
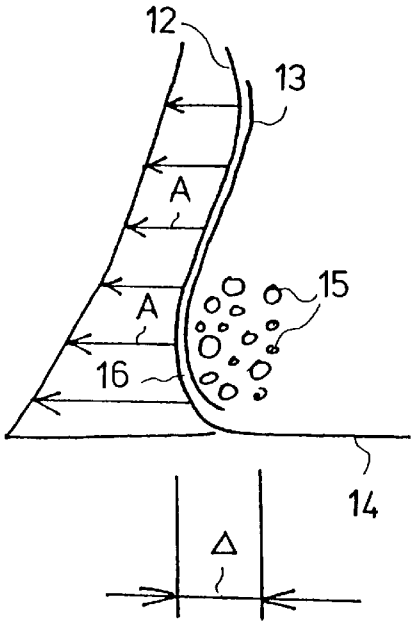
FIG. 2b PRIOR ART
FIG. 2*b* is an illustration in part of the prior-art container as shown in FIG. 1 filled with bulk goods.

When a prior-art container 11 as shown in FIG. 1 is filled with bulk goods 15 in the way indicated in FIGS. 2*a* and 2*b*, it is noticed that in the vicinity of the bottom 14 of the container the lower portion 16 of the container 11 expands. In FIG. 2*b*, the strains in the wall of the container 11 are denoted with the letter A. It should be noticed that, in the prior-art container 11 as shown in FIGS. 1 and 2*a* and 2*b*, exclusively circumferential strains occur. In FIG. 2*b*, the widening of the lower portion 16 of the container 11, i.e. the expansion, is denoted with the letter Δ.

Figure 3:
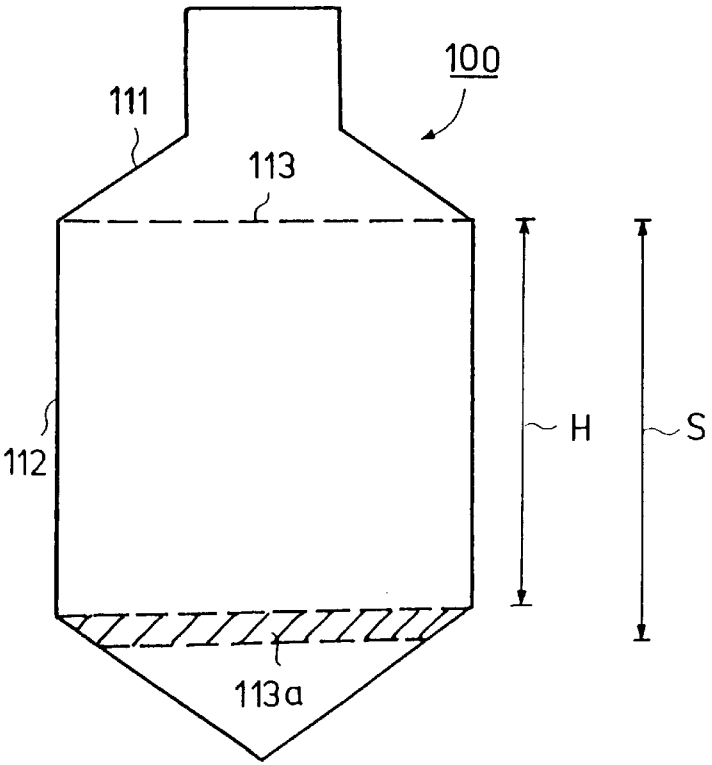
FIG. 3 is a schematic side view of a preferred embodiment of the container in accordance with the invention.

In FIG. 3, the container in accordance with the invention is denoted generally with the reference numeral 100. The container 100 is made of a tubular material 111, and the container 100 comprises an outer wall 112 and a bottom portion 114. Further, the container 100 may possibly also comprise a top portion (not shown).

According to the basic realization of the invention, in the interior of the container 100, a cylindrical reinforcement part 113 has been fitted, which has been fixed to the container 100 so that the cylindrical reinforcement part 113, at the same time, forms at least a part of the bottom 114 of the container. In the embodiment as shown in FIG. 3, the filling height of the container 100 is denoted with the letter H, and the height of the cylindrical reinforcement part 113 with the letter S. It is seen from FIG. 3 that the cylindrical reinforcement part 113 is by its lower portion 113*a* higher than the filling height H of the container.

Figure 4:
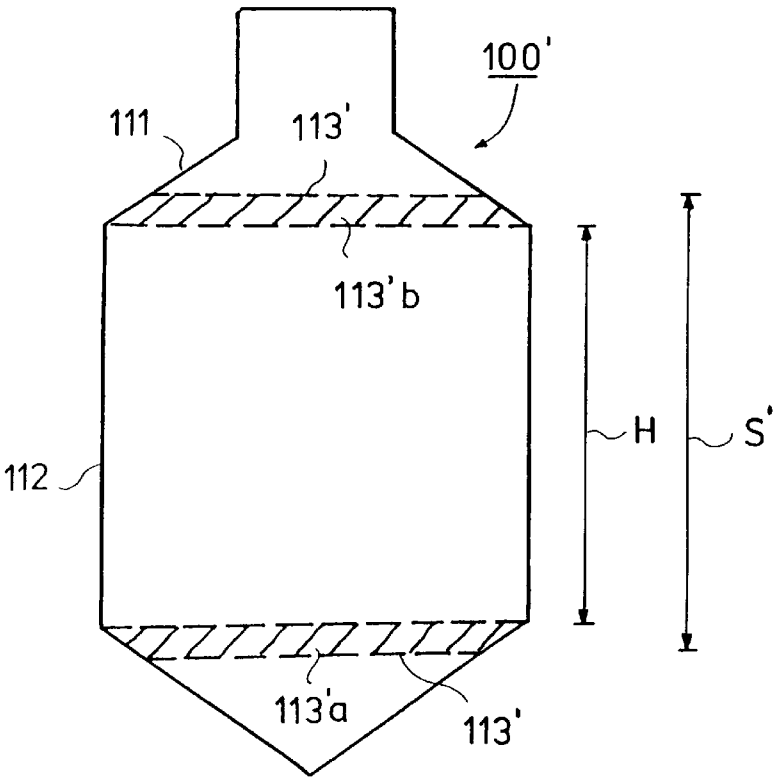
FIG. 4 is a schematic side view of a second preferred embodiment of the container in accordance with the invention.

The container shown in FIG. 4 is denoted generally with the reference numeral 100'. The embodiment shown in FIG. 4 differs from that shown in FIG. 3 in the respect that the height of the cylindrical reinforcement part 113' is by the lower portion 113'*a* and the top portion 113'*b* of the reinforcement part higher than the filling height H of the container 100'. The height of the cylindrical reinforcement part 113' is denoted with the letter S'.

Figure 6:
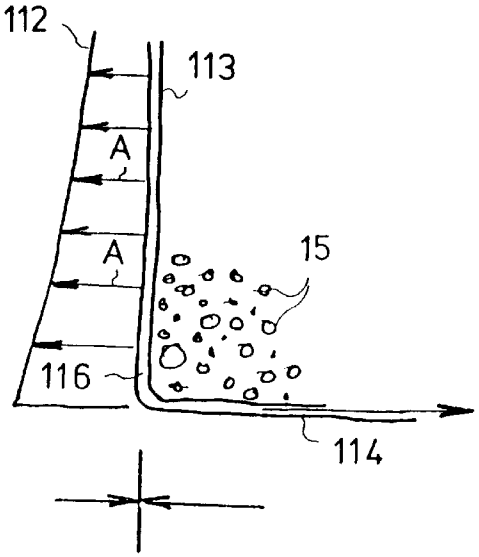
FIG. 6 shows a part of the container as shown in FIG. 3 filled with bulk goods.
Figure 5:
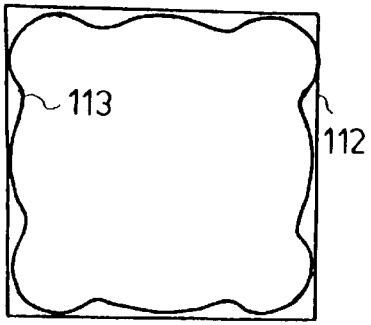
FIG. 5 is a sectional view of the container as shown in FIG. 3 taken at a level of about 100 from the bottom of the container.

From FIGS. 5 and 6 it is seen that, when the container 100 shown in FIG. 3 is filled with bulk goods 15, in the vicinity of the bottom 114 of the container the lower portion 116 of the container 100 cannot expand at all. As is seen from FIG. 6, in the container in accordance with the present invention, a widening of the lower portion of the container, denoted with the letter Δ in FIG. 2*b*, does not occur at all. Of course, the same is also true concerning the second preferred embodiment of the invention illustrated in FIG. 4.

Figure 7:
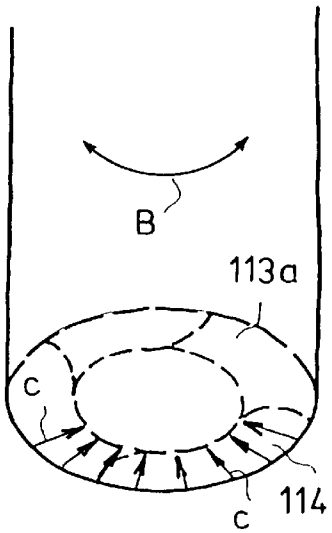
FIG. 7 shows a part of the containers as shown in FIGS. 3 and 4 and illustrates the distribution of strains in the lower portion of the container.

As is seen from FIG. 7, in the container 100 and 100' in accordance with the invention, besides the ordinary circumferential strains B, in the area of the bottom 114, bottom support strains occur, which are denoted with the letter C. Owing to the construction in accordance with the invention the container 100 cannot expand at its lower portion, and similarly the container 100' cannot expand at its lower portion nor at its top portion.

Figure 8:
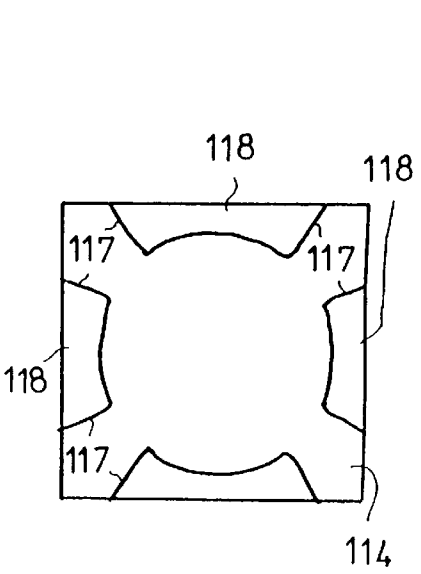
FIG. 8 illustrates the bottom construction or the top construction of a third preferred embodiment of the container in accordance with the invention.

As is shown in FIG. 8, in practice it is, as a rule, preferable to make cuts 117 into the corners of the lower portion 113*a* of the reinforcement part 113 or into the corners of the lower portion 113'*a* and the top portion 113'*b* of the reinforcement part 113', respectively, in which case the space between the reinforcement part and the outer wall 112 is filled and emptied readily. Owing to the cuts 117, sector-shaped portions 118 are formed in the reinforcement part 113 or 113', respectively.

Above, some preferred embodiments of the invention have been shown, and it is obvious to a person skilled in the art that numerous modifications can be made to said embodiments within the scope of the inventive idea defined in the accompanying patent claims.

I claim:

1. In a container for bulk goods made of a resilient material and which comprises an outer wall and a bottom portion extending from a lower edge of the outer wall to define a receptacle for the bulk goods, the improvement comprising:

a cylindrical reinforcement part arranged in an interior of and fixed to the container such that a space is defined between at least a part of said cylindrical reinforcement part and the outer wall of the container, said cylindrical reinforcement part being structured and arranged to overlie at least a part of said bottom portion of the container.

2. A container as claimed in claim 1, wherein the height of the outer wall from an upper edge of the outer wall to the lower edge of the outer wall defines a filling height of the container, said cylindrical reinforcement part extending from the upper edge of the outer wall of the container and having a height from the upper edge of the outer wall of the container to an edge overlying the at least a part of the bottom portion of the container which is larger than the filling height of the container.

3. A container as claimed in claim 1, wherein the container includes a top portion extending from an upper edge of the outer wall, said cylindrical reinforcement part being structured and arranged to underlie at least a part of the top portion of the container, the height of the outer wall from the upper edge to the lower edge defining a filling height of the container, said cylindrical reinforcement part having a height from an edge underlying the top portion of the container to an edge overlying the bottom portion of the container which is larger than the filling height of the container.

4. A container as claimed in claim 1, wherein said cylindrical reinforcement part is fixed to the outer wall and to the bottom portion of the container.

5. A container as claimed in claim 1, wherein the container includes a top portion extending from an upper edge of the outer wall, said cylindrical reinforcement part underlying and being fixed to at least a part of the top portion of the container.

6. A container as claimed in claim 1, wherein said cylindrical reinforcement part includes a lower portion having corners in which cuts are made to form sector-shaped portions in said cylindrical reinforcement part and thereby enable the bulk goods to pass between an interior of said cylindrical reinforcement part and the space between said cylindrical reinforcement part and the outer wall of the container.

7. The use of a cylindrical reinforcement part as claimed in claim 1 as an inner construction in a package.

8. A container for bulk goods made of a resilient material, comprising an outer wall having a lower edge and a bottom wall connected to said outer wall at said lower edge, said outer wall and said bottom wall defining an interior in which the bulk goods are placed, and a cylindrical member arranged in said interior and fixed to said outer wall to reinforce said outer wall such that a space is defined between at least a part of said cylindrical member and said outer wall, said cylindrical member having a lower portion overlying at least a part of said bottom wall.

9. The container of claim 8, wherein said outer wall has an upper edge, a length of said outer wall from said upper edge to said lower edge defining a filling height of the container, said cylindrical member having an upper edge adjacent said upper edge of said outer wall and a lower edge on said lower portion, a length of said cylindrical member from said upper edge to said lower edge being larger than a length of said outer wall from said upper edge to said lower edge and thus the filling height of the container.

10. The container of claim 8, wherein said outer wall has an upper edge, further comprising a top wall connected to said outer wall at said upper edge, a length of said outer wall from said upper edge to said lower edge defining a filling height of the container, said cylindrical member having a top portion underlying at least a part of said top wall, said cylindrical member having an upper edge on said top portion and a lower edge on said lower portion, a length of said cylindrical member from said upper edge to said lower edge being larger than a length of said outer wall from said upper edge to said lower edge and thus the filling height of the container.

11. The container of claim 10, wherein said top portion of said cylindrical member is fixed to said top wall.

12. The container of claim 8, wherein said lower portion of said reinforcement member is fixed to said bottom wall.

13. The container of claim 8, wherein said outer wall and said cylindrical member are made of polyolefin plastic.

14. The container of claim 8, wherein said outer wall and said cylindrical member are made of plastic film.

15. The container of claim 8, wherein said cylindrical member is fixed to said outer wall such that said space defined between said cylindrical member and said outer wall is in communication with an interior of said cylindrical member.

16. The container of claim 8, wherein said cylindrical member is fixed only at discrete locations to said outer wall such that between said discrete locations, said cylindrical member is separate from said outer wall.

17. A container as claimed in claim 1, wherein the container includes a top portion extending from an upper edge of the outer wall, said cylindrical reinforcement part being structured and arranged to underlie at least a part of the top portion of the container, said cylindrical reinforcement part including lower and top portions having corners in which cuts are made to form sector-shaped portions in said cylindrical reinforcement part and thereby enable the bulk goods to pass between an interior of said cylindrical reinforcement part and the space between said cylindrical reinforcement part and the outer wall of the container.

18. The container of claim 1, wherein the outer wall and said cylindrical reinforcement part are made of polyolefin plastic.

19. The container of claim 1, wherein the outer wall and said cylindrical reinforcement part are made of plastic film.

20. The container of claim 1, wherein said cylindrical reinforcement part is fixed to the outer wall such that said space defined between said cylindrical reinforcement part and the outer wall of the container is in communication with an interior of said cylindrical reinforcement part.

* * * * *